US011746739B1

(12) United States Patent
Garcia

(10) Patent No.: US 11,746,739 B1
(45) Date of Patent: Sep. 5, 2023

(54) BOUYANCY ENERGY CONVERSION SYSTEM AND METHOD

(71) Applicant: Dankiel Garcia, West Palm Beach, FL (US)

(72) Inventor: Dankiel Garcia, West Palm Beach, FL (US)

( * ) Notice: Subject to any disclaimer, the term of this patent is extended or adjusted under 35 U.S.C. 154(b) by 0 days.

(21) Appl. No.: 18/078,436

(22) Filed: Dec. 9, 2022

Related U.S. Application Data

(60) Provisional application No. 63/287,589, filed on Dec. 9, 2021.

(51) Int. Cl.
*F03B 13/00* (2006.01)
*F03B 13/18* (2006.01)
*B63B 35/44* (2006.01)

(52) U.S. Cl.
CPC ..... *F03B 13/1885* (2013.01); *B63B 35/44* (2013.01); *B63B 2035/4466* (2013.01)

(58) Field of Classification Search
CPC ..... F03B 13/24; F03B 13/1845; F03B 13/14; F03B 13/142; F03B 13/188; F03B 13/1885; F03B 13/20; F03B 15/00; F05B 2240/97; F05B 2280/5001; Y02E 10/32; Y02E 10/38
See application file for complete search history.

(56) References Cited

U.S. PATENT DOCUMENTS 4,326,132 A * 4/1982 Bokel ..... F03B 17/02 290/1 R
4,363,212 A * 12/1982 Everett ..... F03B 17/02 415/7
5,555,728 A * 9/1996 Welch, Jr. ..... F03B 17/02 60/496
6,791,205 B2 9/2004 Woodbridge
7,319,278 B2 1/2008 Gehring
7,538,445 B2 5/2009 Kornbluh et al.
7,808,120 B2 10/2010 Smith
8,253,263 B2 8/2012 Atilano et al.
8,319,360 B1 11/2012 Omer
8,497,593 B2 7/2013 Klukowski
8,581,433 B2 11/2013 Sidenmark
8,593,004 B2 11/2013 Piccinni
8,823,196 B1 9/2014 Gehring
8,826,658 B2 9/2014 Foster et al.
(Continued)

*Primary Examiner* — Shafiq Mian
(74) *Attorney, Agent, or Firm* — The Patent Professor, P.A.; John Rizvi

(57) ABSTRACT

A buoyancy energy conversion system and method for converting buoyant forces to rotational energy may comprise a pair of reciprocating buoyancy tanks connected to a common drive cable. The pair of buoyancy tanks may be alternatively filled and emptied of compressed gas to alternately raise and lower the pair of buoyancy tanks within a water column. The ends of the drive cable are connected to opposed sides of a drive assembly such that the rising and lowering of the pair of buoyancy tanks within the water column rotates the drive assembly. The buoyancy energy conversion system may include an upper frame assembly mounted to a floating structure and supporting the drive assembly and a weighted lower frame assembly supporting said drive cable. A source and system of compressed gas and valves may force compressed gas and water into and out of the pair of buoyancy tanks.

20 Claims, 11 Drawing Sheets

(56) References Cited

U.S. PATENT DOCUMENTS

| | | | | |
|---|---|---|---|---|
| 9,068,552 | B2 | 1/2015 | Kawaguchi et al. | |
| 9,322,386 | B1 * | 4/2016 | Kirsch | F03B 7/006 |
| 9,435,317 | B2 | 9/2016 | Cunningham et al. | |
| 10,190,568 | B2 | 1/2019 | Gregory | |
| 10,240,575 | B2 | 3/2019 | Dragic | |
| 10,273,931 | B2 | 4/2019 | Ohlsson | |
| 10,641,235 | B2 | 5/2020 | Dragic | |
| 10,920,741 | B1 * | 2/2021 | Duan | F03B 13/266 |
| 2007/0018458 | A1 | 1/2007 | Martinez | |
| 2007/0089409 | A1 | 4/2007 | Serrano Molina | |
| 2011/0012358 | A1 | 1/2011 | Brewster et al. | |
| 2013/0009402 | A1 | 1/2013 | Williams | |
| 2013/0055707 | A1 | 3/2013 | Ruiz-Diez | |
| 2013/0199171 | A1 | 8/2013 | Brink | |
| 2013/0200626 | A1 | 8/2013 | Sidenmark et al. | |
| 2015/0013325 | A1 | 1/2015 | Dehlsen | |
| 2016/0186715 | A1 | 1/2016 | Fait | |
| 2021/0047993 | A1 | 2/2021 | Zhong | |
| 2022/0356863 | A1 * | 11/2022 | Shintani | H02S 10/10 |

* cited by examiner

BOUYANCY ENERGY CONVERSION SYSTEM AND METHOD

CROSS-REFERENCE TO RELATED APPLICATIONS

This application claims the benefit of U.S. Provisional Patent Application No. 63/287,589, filed on Dec. 9, 2021, which is incorporated herein by reference in its entirety.

FIELD OF THE INVENTION

The present invention relates generally to energy generation or conversion systems and methods, and more particularly, to a system and method of converting the energy of buoyant objects submerged in a liquid to rotational energy.

BACKGROUND OF THE INVENTION

Floating structures, such as boats, barges and the like, frequently have a need for a rotating drive mechanism to power various features or devices of the floating structure. Such devices may include drive shafts and propellers, winches, etc. These devices are most often powered by fossil fuel engines which are expensive to run and maintain and rely on a source of fuel.

Electric devices such as motors are also available to generate a rotary movement and thereby run the aforementioned features or devices. However, electric motor performance is limited by the capacity of the electrical battery or batteries powering the motor. Additionally, the caustic and electrical hazards of using battery systems to provide electrical power is a major concern in a wet and sometimes salty environment.

Accordingly, there is a need for a solution to at least one of the aforementioned problems. For instance, there is an established need for a system and method of rotating a drive shaft using clean power generally available on floating structures.

SUMMARY OF THE INVENTION

The present invention is directed to a buoyancy energy conversion system and method for converting buoyant forces on a tank to rotational energy. The buoyancy energy conversion system and method may comprise or utilize a pair of reciprocating buoyancy tanks connected to a common drive cable. The pair of buoyancy tanks may be alternatively filled and emptied of compressed gas to alternately raise and lower the pair of buoyancy tanks within a water column. The ends of the drive cable may be connected to opposed sides of a drive assembly such that the rising and lowering of the pair of buoyancy tanks within the water column rotates the drive assembly. The buoyancy energy conversion system may further include an upper frame assembly mounted to a floating structure and supporting the drive assembly and a weighted lower frame assembly supporting said drive cable. A source and system of compressed gas and valves may force compressed gas and water into and out of the pair of buoyancy tanks.

In a first implementation of the invention, a buoyancy energy conversion system for converting buoyant forces to rotational energy is provided, the buoyancy energy conversion system comprising:

a pair of buoyancy tanks, each buoyancy tank of the pair of buoyancy tanks including a first reservoir defining an internal cavity and having a bottom opening and an exhaust valve positioned at a top of said first reservoir;

an upper roller assembly arrangeable above water level;

a lower roller assembly arrangeable below water level;

a drive cable connected to each of said buoyancy tanks of said pair of buoyancy tanks, the drive cable configured to reciprocally roll along the upper and lower roller assemblies;

a drive assembly connected to the drive cable; and a source of compressed gas for alternately filling each buoyancy tank of said pair of buoyancy tanks with compressed gas, wherein each buoyancy tank is configured to rise in a water column when filled with said compressed gas and to pull downward on the drive cable and the other buoyancy tank to thereby exert a torque on the drive assembly.

In a second aspect, each buoyancy tank may further include a second reservoir having an admission valve for allowing compressed gas into an internal cavity of the second reservoir and at least one valve for exhausting compressed gas from the internal cavity of the second reservoir into the internal cavity of the first reservoir.

In another aspect, the buoyancy energy conversion system may further include a compressed gas source arranged externally to pair of buoyancy tanks, the compressed gas source configured to alternatively inject compressed gas into each buoyancy tank when said each buoyancy tank is arranged at a bottommost position within the water column.

In another aspect, the compressed gas source may comprise an electrolysis apparatus.

In another aspect, the drive assembly may include a drive disk connected to the drive cable.

In another aspect, the drive assembly may include a drive shaft affixed to the drive disk and configured for joint rotation with the drive disk.

In another implementation of the invention, a method for converting buoyant forces to rotational energy may comprise the steps of:

obtaining a buoyancy energy conversion system comprising a pair of buoyancy tanks, a drive cable, and a rotatable driven member, wherein each buoyancy tank of the pair of buoyancy tanks comprises a respective first reservoir defining a respective internal cavity, wherein the drive cable interconnects the pair of buoyancy tanks to the rotatable driven member and is configured to drive the rotatable driven member for rotation, wherein the buoyancy energy conversion system is arranged in a body of water comprising a water surface level, and further wherein said each buoyancy tank is configured to travel reciprocally upward and downward along the body of water and exert a respective upward pulling force on the drive cable when traveling upward along the body of water;

for each buoyancy tank of the pair of buoyancy tanks:

a) allowing said each buoyancy tank to travel downward through the body of water from an upper position to a lower position as a result of the other buoyancy tank exerting its respective upward pulling force on the drive cable as said other buoyancy tank travels upward through the body of water, b) as said each buoyancy tank travels downward through the body of water, driving said rotatable driven member for rotation by applying a torque on the rotatable driven member, the torque caused by a pulling on the rotatable driven member exerted by the drive cable, c) with said each buoyancy tank at the lower position, injecting compressed gas into the respective internal cavity of the respective first reservoir of said each buoyancy tank, d) allowing said each buoyancy tank to travel upward through the body of water as a result of said compressed gas occupying the respective internal cavity of the respective first reservoir of said each buoyancy tank, e) as said each buoyancy tank travels upward through the body of water, exerting the respective upward pulling force of said each buoyancy tank on the drive cable, f) with said each buoyancy tank at the upper position, expelling said compressed gas from said respective internal cavity of the respective first reservoir of said each buoyancy tank; and repeating steps a) through f) cyclically.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a buoyancy energy conversion system including a pair of reciprocating buoyancy tanks for converting buoyant forces to rotational energy to drive a rotary shaft.

Figure 1:
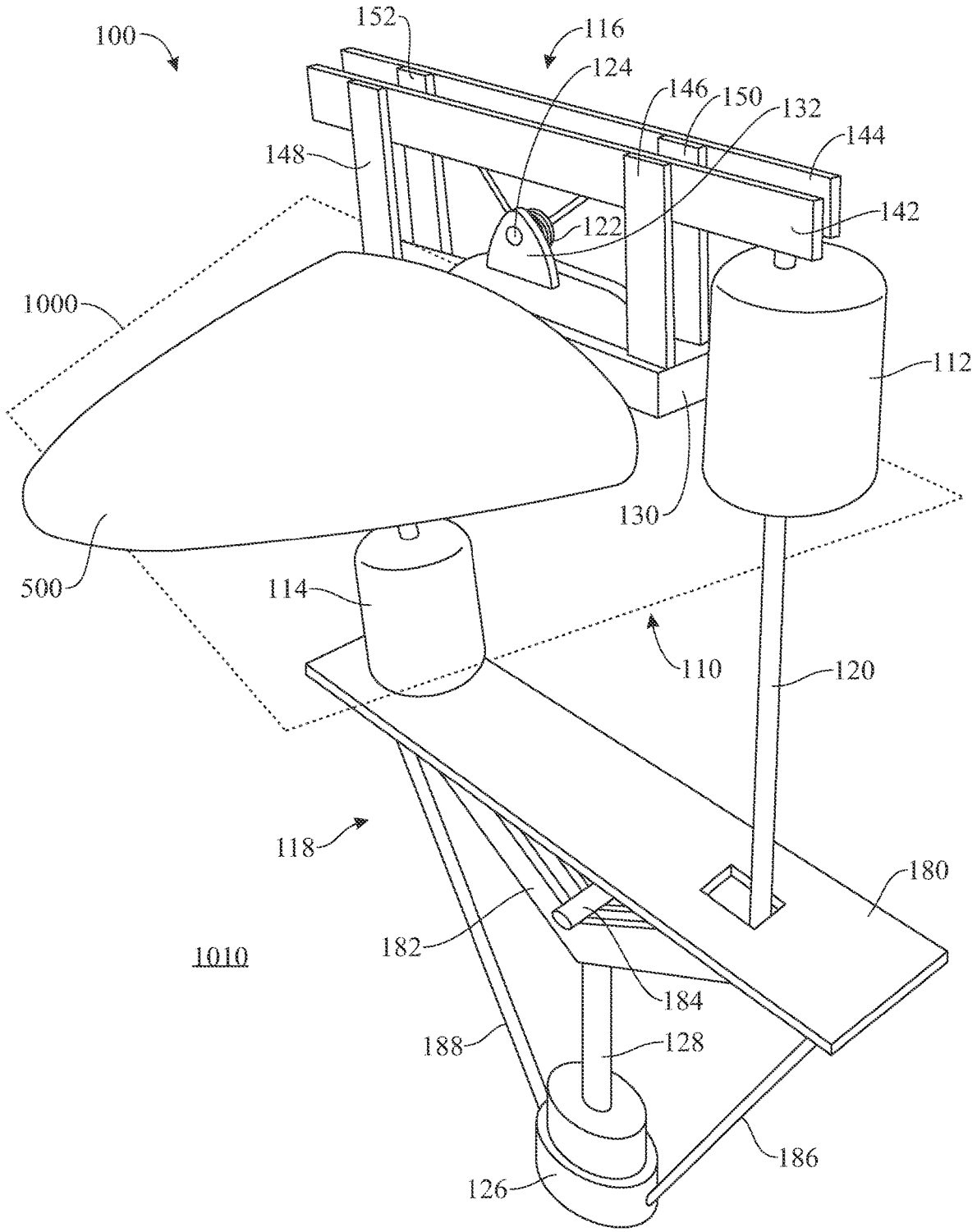
FIG. 1 presents top, front perspective view of a buoyancy energy conversion system, attached to a floating structure, in accordance with a first illustrative embodiment of the present invention.
Figure 2:
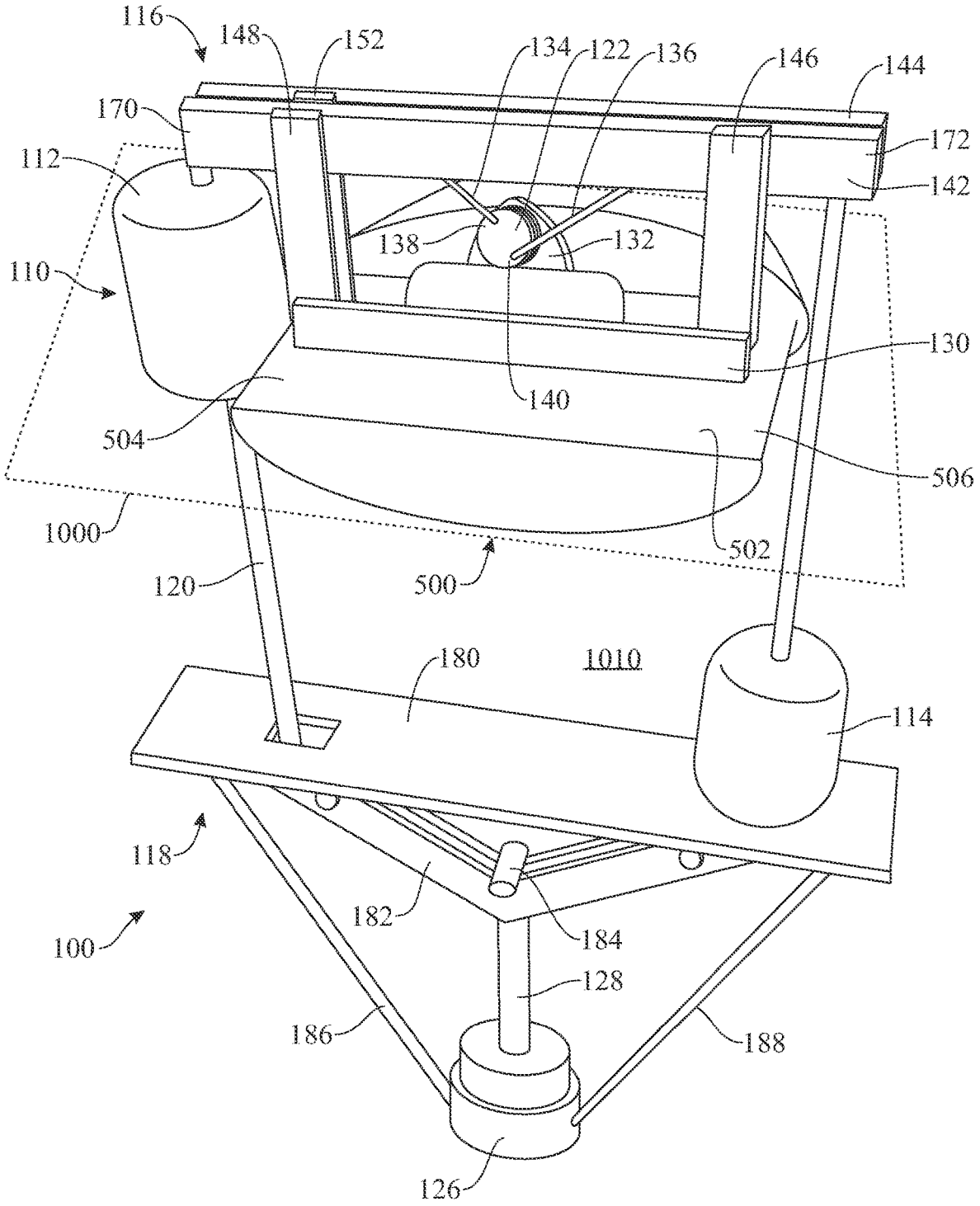
FIG. 2 presents a top, rear perspective view of the buoyancy energy conversion system of in FIG. 1.

Referring to FIGS. 1-4, and initially with regard to FIGS. 1 and 2, a buoyancy energy conversion system for converting buoyant forces in a water column to rotational energy, hereinafter buoyancy energy conversion system 100, is illustrated in accordance with a first exemplary embodiment of the present invention. The buoyancy energy conversion system 100 generally includes a pair of reciprocating buoyancy tanks 110, including a first buoyancy tank 112 and a second buoyancy tank 114, suspended between an upper frame assembly 116 and a lower frame assembly 118 of the buoyancy energy conversion system 100. The first and second buoyancy tanks 112 and 114, respectively, are connected to a reciprocating drive cable 120. The first and second buoyancy tanks 112 and 114 reciprocate the drive cable 120 in response to an opposed rise and fall of the first and second buoyancy tanks 112 and 114 within the water column.

The buoyance energy conversion system additionally includes a drive disk 122 connected to the drive cable 120, and a rotatable drive shaft 124 extending from the drive disk 122. The drive disk 122 is rotatably mounted on the upper frame assembly 116. Reciprocation of the drive cable 120 in response to opposed movement of the pair of buoyance tanks 110 reciprocally rotates the drive disk 122 to rotate the drive shaft 124 for use in providing rotational energy to one or more external devices.

The disclosed buoyancy energy conversion system 100 may be designed to be used on or attached to a supporting structure, which is generally located at or proximate to a water column or body of water. In some embodiments, the supporting structure may be provided on land. In other embodiments, the supporting structure may be affixed to a floor of the body of water. In yet another non-limiting example, such as the embodiments shown in the drawings, the supporting structure may be provided by a floating structure, such as, but not limited to, a ship or boat 500. The upper frame assembly 116 is attached to the boat 500 and is positioned above a water line 1000 while the lower frame assembly 118 is suspended from the boat 500 and submerged within the water column 1010, beneath the boat 500 and water line 1000, by the drive cable 120. A weighted structure, hereinafter referred to generically as weight 126, is attached to the lower frame assembly 118 to hold the lower frame assembly 118 down within the water column 1010 beneath the water line 1000. The weight 126 may be directly attached to the lower frame assembly 118 or may be suspended beneath the lower frame assembly 118 by a cable or shaft 128 as shown. Alternatively, the lower frame assembly 118 may be secured or anchored to the floor (not shown) of a bay, lake, ocean, river, etc. containing the water column 1010 directly by an anchor or other securing mechanism. The lower frame assembly 118 may be generally static relative to the floor.

With continued reference to FIGS. 1 and 2, the upper frame assembly may generally include a base 130 affixed to an upper surface 502 of the boat 500. A mounting plate 132 may be provided on the base 130 and may rotatably support the drive disk 122 and the drive shaft 124. As best shown in FIG. 2, opposed ends 134 and 136 of the drive cable 120 of the present embodiment are attached to the drive disk 122. The opposed ends 134 and 136, may be attached to outer or peripheral points 138 and 140 on the drive disk 122, respectively, spaced apart from a central longitudinal axis of the drive shaft 124 (which may be arranged at a center of the drive disk 122) such that alternate pulling forces exerted on the opposed ends 134 and 136 of the drive cable 120 in opposite directions rotate the drive disk 122, and thus the drive shaft 124, about the central longitudinal axis of the drive shaft 124 and within the mounting plate 132 on the base 130 of the upper frame assembly 116.

The upper frame assembly 116 may additionally include a pulley-supporting structure, which may include an elongated, first horizontal support 142 and an elongated second horizontal support 144 which may be arranged parallel to and spaced-apart with the first horizontal support 142. First and second vertical legs 146 and 148 may extend upward from the base 130 and support the first horizontal support 142 above the base 130 and thus above the boat 500 and the waterline 1000. Similarly, third and fourth vertical legs 150 and 152 may extend upward from the base 130 and support the second horizontal support 142 above the base 130 and waterline 1000. The first and second horizontal supports 142 and 144, respectively, may be provided to support an upper pulley assembly 160 (FIG. 3) above the waterline 1000. The upper pulley assembly 160 allows the first and second buoyancy tanks 112 and 114 to alternately be raised upward and at least partially out of the water column 1010.

Figure 3:
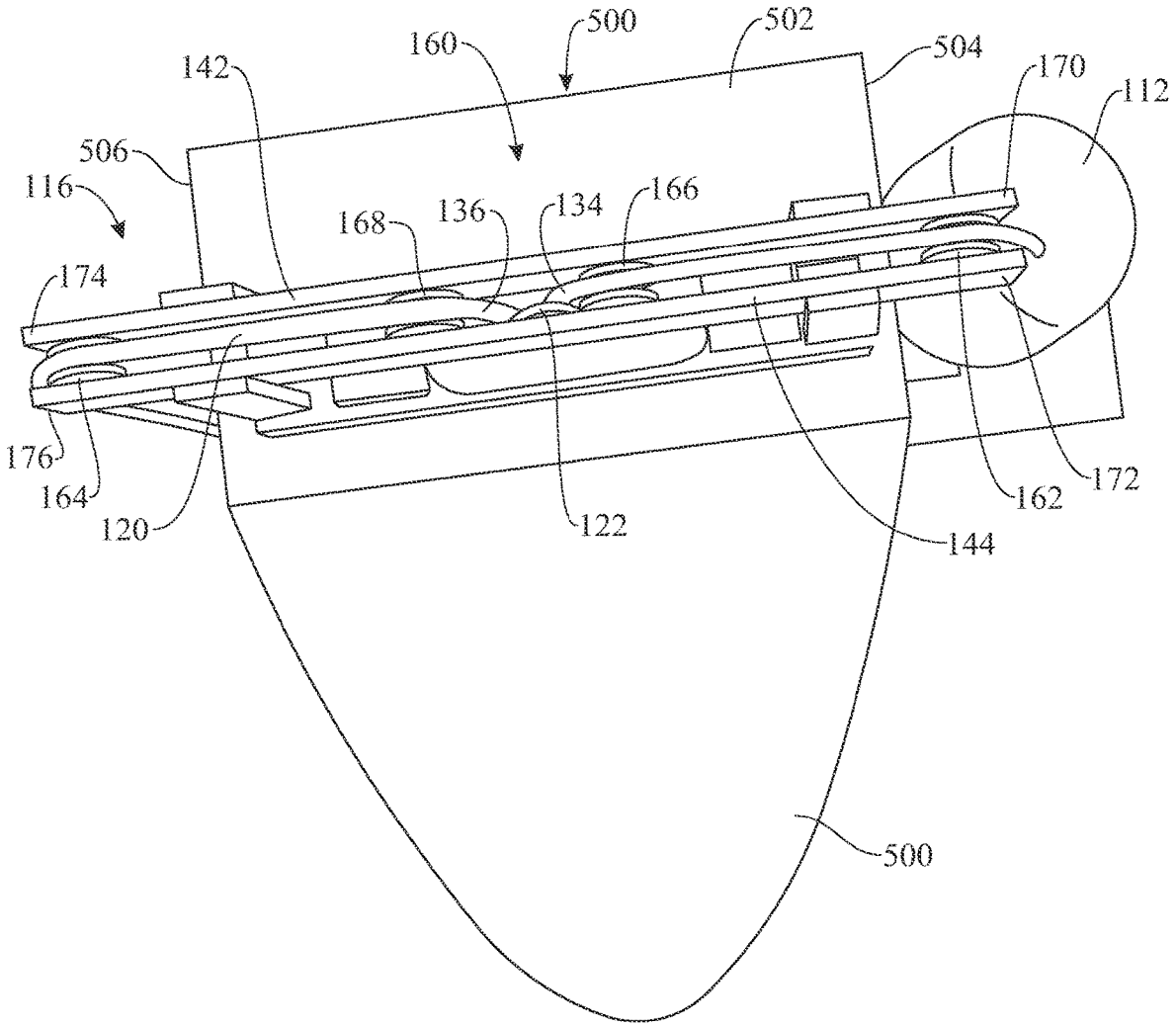
FIG. 3 presents a top perspective view of a top frame and upper pulley assembly of the buoyancy energy conversion system of FIG. 1 extending above the floating structure.

Referring for the moment to FIG. 3, the upper pulley assembly 160 may be positioned and rotatably mounted between the first and second horizontal supports 142 and 144. The upper pulley assembly 160 may support the drive cable 120 in its reciprocal motion and generally includes first and second outboard pulleys 162 and 164 and first and second inboard pulleys 166 and 168. The first and second inboard pulleys 166 and 168 may be located closer to the drive shaft 124 than the first and second outboard pulleys 162 and 164. The first and second outboard pulleys 162 and 164, respectively, may be positioned outward of sides 504 and 506 of the boat 500, facilitating pulling up the first and second buoyancy tanks 112 and 114 out of the water column 1010 (FIG. 1) without hitting the boat 500. The first outboard pulley 162 may be positioned and rotatably mounted between outer ends 170 and 172 of the first and second horizontal supports 142 and 144, respectively. Similarly, the second outboard pulley 164 is positioned and rotatably mounted between outer ends 174 and 176 of the first and second horizontal supports 142 and 144, respectively, which may be arranged opposite to the outer ends 170 and 172, respectively. The first and second inboard pulleys 166 and 168 may be positioned and rotatably mounted inward of the first and second outboard pulleys 162 and 164 and adjacent to the drive disk 122. The first and second outboard pulleys 162 and 164 and the first and second inboard pulleys 166 and 168 rotatably support the drive cable 120 above the waterline 1000 (FIG. 2).

Turning now to FIGS. 1, 2, 4 and 5, the lower frame assembly 118 is provided as a lower travel limit for the first and second buoyancy tanks 112 and 114 beneath the water line 1000. As noted above, the lower frame assembly 118 of the present embodiment is maintained in a generally fixed position beneath the waterline 1000 by the weight 126. The lower frame assembly 118 may generally include a base plate 180. A V-shaped lower support 182 may extend downward from the base plate 180. The weight 126 may be suspended from the lower support 182 by a cross-bar 184 connected to the weight shaft 128 and positioned in the "V" or vertex area of the V-shaped lower support 182. In some embodiments, the cross-bar 184 may be retained within the "V" or vertex area of the V-shaped lower support 182 by gravity. In some embodiments, stabilizer bars 186 and 188 may extend between the weight 126 and the base plate 180, and may contribute to prevent the weight 126 from swaying due to motion of the boat 500 above and maintain the weight 126 in a generally fixed position.

Figure 4:
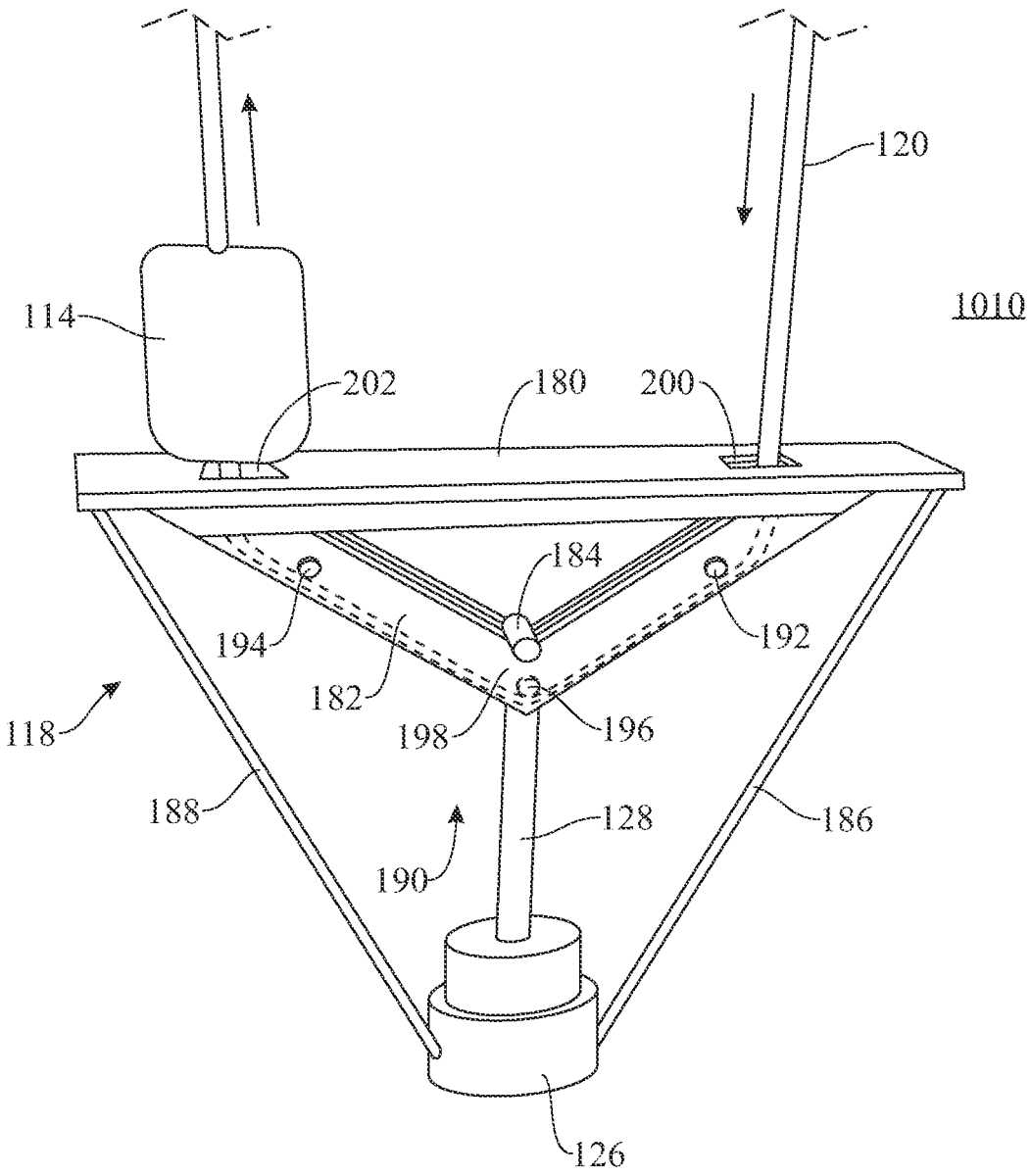
FIG. 4 presents a front perspective view of a lower frame and lower pulley assembly of the buoyancy energy conversion system of FIG. 1.
Figure 5:
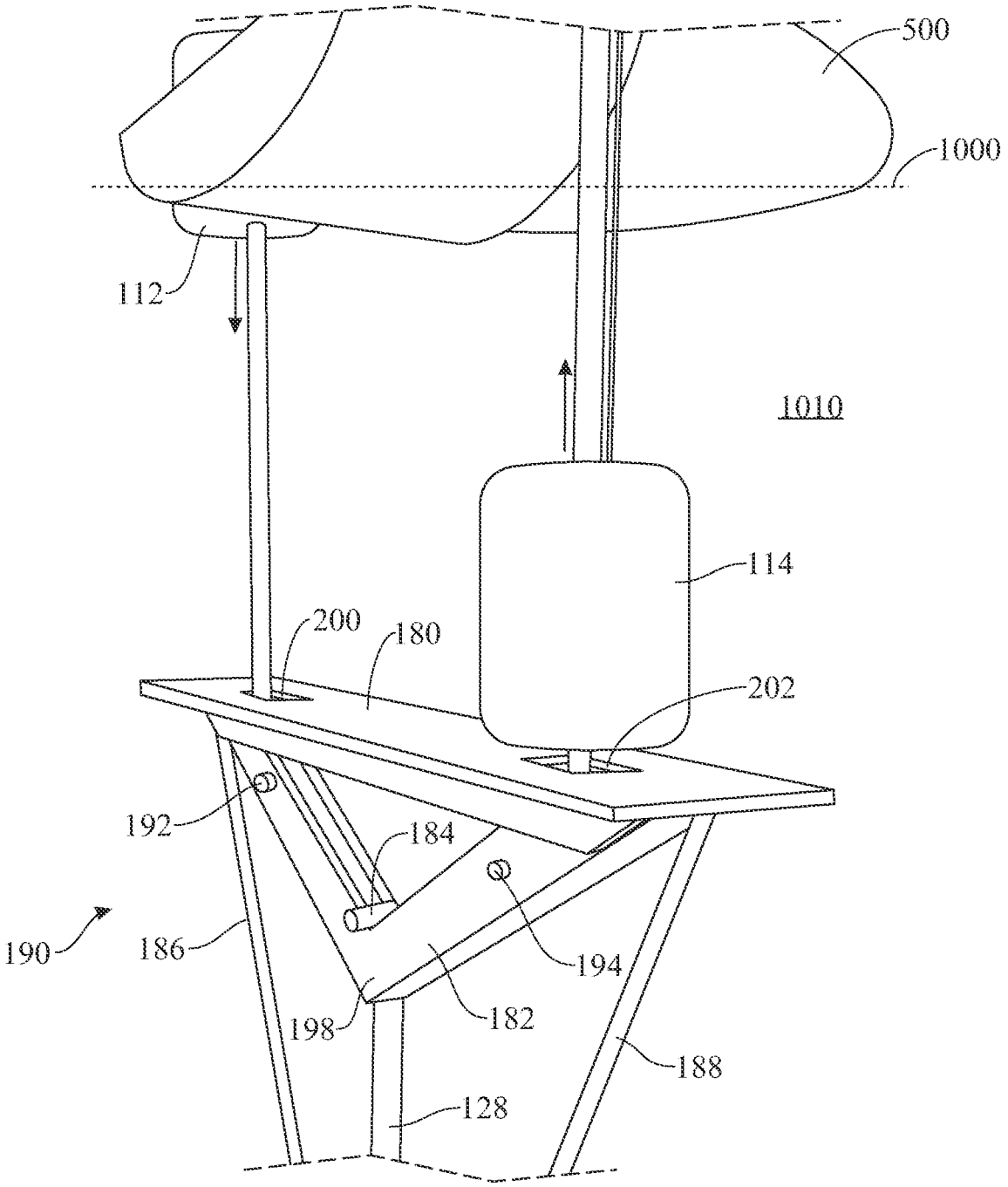
FIG. 5 presents a front perspective view of the lower frame of the buoyancy energy conversion system of FIG. 1, including a pair of reciprocating buoyancy tanks, suspended beneath the floating structure.

Referring specifically to FIGS. 4 and 5, the disclosed buoyancy energy conversion system 100 additionally includes a lower pulley or roller assembly 190. The lower pulley or roller assembly 190 may be positioned and rotatably mounted in the V-shaped lower support 182 and may allow for a smooth passage of the drive cable 120 through the lower frame assembly 118 as the first and second buoyancy tanks 112, 114 move up and down within the water column 1010 and alternately pull on the drive cable 120. In some embodiments, the lower roller assembly 190 may include a first outboard roller 192, a second outboard roller 194 and a central roller 196. The central roller 196 may be positioned at the apex 198 of the V-shaped lower support 182. The central roller 196 and the weight shaft 128 may be offset from each other such that the weight shaft 128 does not interfere with the motion of the drive cable 120 as it passes through the lower support 182. For example, the weight shaft 128 may be arranged behind the drive cable 120, from the point of view of FIG. 4.

With continued reference to FIG. 4, the base plate 180 may define a pair of spaced apart windows 200 and 202 positioned proximate to the first and second outboard pulleys 162 and 164, respectively, of the upper pulley assembly 160. The windows 200, 202 may allow the drive cable 120 to pass through the base plate 180 and around the lower roller assembly 190. The windows 200 and 202 may be arranged substantially in vertical alignment with the first and second outboard pulleys 162 and 164, respectively, of the upper pulley assembly 160. The first and second outboard rollers 192 and 194 are positioned at outer ends 204 and 206 of the V-shaped lower support 182, respectively. The first and second outboard rollers 192 and 194 may be located directly or approximately beneath the first and second windows 200 and 202 in the base plate 180 such that the first and second outboard rollers 192 and 194 are in line with first and second outboard pulleys 162 and 164, respectively, to allow the drive cable 120 the first and second buoyancy tanks 112 and 114 attached thereto, to move straight up and down within the water column 1010 in a generally vertical direction.

Figure 6:
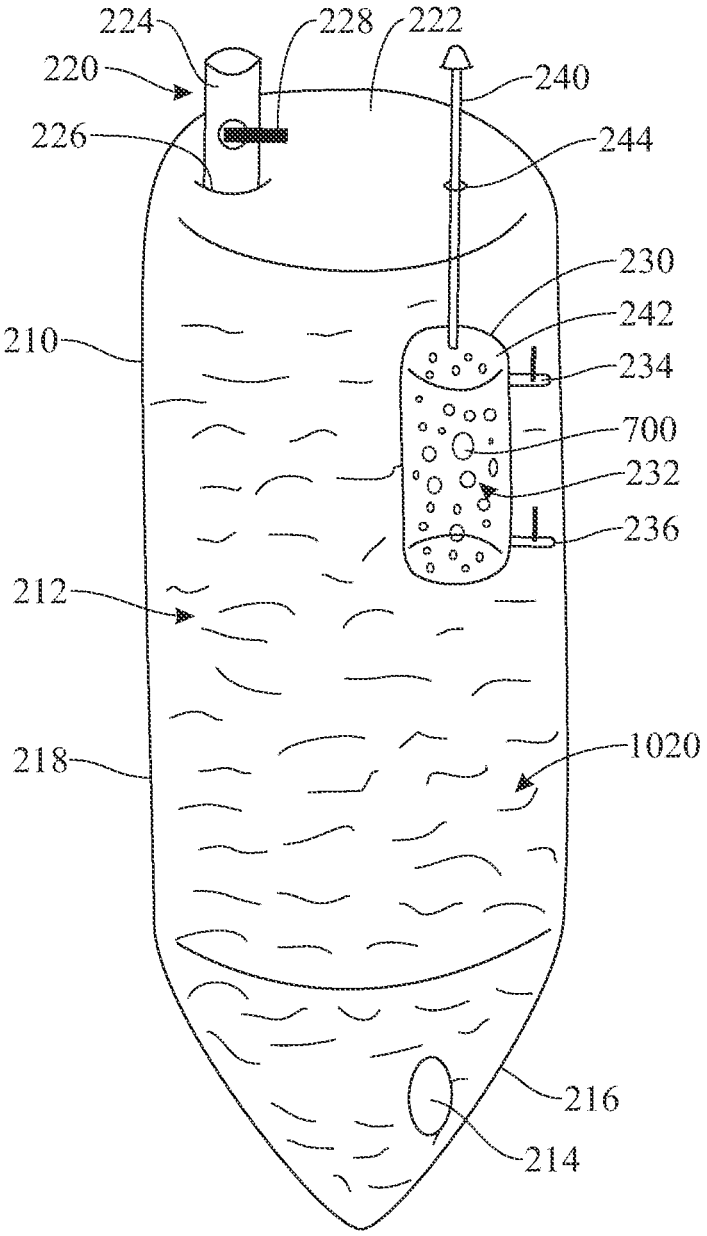
FIG. 6 presents a side perspective view of one of the buoyancy tanks of the buoyancy energy conversion system of FIG. 1.

Turning now to FIG. 6, details of the buoyancy tanks 112 and 114 of the present embodiment will now be described. The first buoyancy tank 112 may generally include a hollow, first tank or reservoir 210 defining an internal cavity 212. The first reservoir 210 may further define a lower or bottom opening 214 at a bottom end 216 of the first reservoir 210 to allow for the ingress and egress of water to the internal cavity 212 of the first reservoir 210. The bottom end 216 of the first reservoir 210 may be conical or otherwise generally hydrodynamic to facilitate passage of the buoyancy tank 112 down through the water column 1010. In a non-limiting example of the invention, the first reservoir 210 may have an internal volume, or capacity of the internal cavity 212, of 200 liters.

The first reservoir 210 may further include a cylindrical central portion 218 extending from the bottom end 216, and an exhaust valve 220, which may be positioned through a top side or end 222 of the first reservoir 210 opposite the bottom end 216. The exhaust valve 220 may extend through a first top opening 226 in the top end 222 of the first reservoir 210. The exhaust valve 220 may be provided to release gas from the internal cavity 212 of the first reservoir 210 when the first buoyancy tank 112 is arranged at least partially above the water line 1000, as will be described in greater detail hereinafter, and to instead retain water 1020 within the internal cavity 212 of the first reservoir 210 as the first buoyancy tank 112 descends through the water column 1010.

More specifically, the exhaust valve 220 may allow air or gas to release from within the internal cavity 212 of the first reservoir 210 when the first reservoir 210 reaches its highest most point of travel above the water line 1000, so that water can enter through the bottom opening 214 of the first reservoir 210 once the first buoyancy tank 112 starts traveling downward into and through the water column 110. The exhaust valve 220 may generally include an exhaust tube 224 extending through the first top opening 226 in the top end 222 of the first reservoir 210 and a valve actuator 228, schematically depicted as a lever for simplicity, to regulate or control the flow of air and/or gasses through the exhaust tube 224 from outside the exhaust valve 220. For instance and without limitation, the exhaust valve 220 may be a float type valve and the valve actuator 228 may be configured to float in the water column 1010 to move the exhaust valve 220 to a closed condition as the first buoyancy tank 112 descends through the water column 1010 and to drop down upon rising above the water line 1000 to open the exhaust valve 220 and allow any air and/or gasses in the internal cavity 212 of the first reservoir 210 to vent out of the internal cavity 212 of the first reservoir 210.

With continued reference to FIG. 6, the first buoyancy tank 112 may further include a hollow, second tank or reservoir 230, which is carried by or movable with the first reservoir 210 along the water column 101. For instance, in some embodiments, such as the present embodiment, the second reservoir 230 may be positioned within the internal cavity 212 of the first reservoir 210, such that the first reservoir 210 constitutes an external tank and the second reservoir 230 constitutes an internal tank. However, alternative embodiments are contemplated without departing from the scope of the present disclosure. For example, in some embodiments, the first reservoir 210 may be internal to the second reservoir 230, which in turn may be formed as a relatively thin hollow layer formed outside and over the first reservoir 210. In other illustrative embodiments, the first and second reservoirs 210, 230 may be provided adjacent and affixed to one another.

The second tank or reservoir 230 is configured to hold compressed gas (e.g., compressed air). The second reservoir 230 allows to fill the first buoyancy tank 112 with air and/or gas so that the first buoyancy tank 112 becomes buoyant within the water column 1010, and thus rises to pull on, and consequently move, the attached drive cable 120. The second reservoir 230 comprises an internal cavity 232 configured to contain at least one compressed gas (hereinafter referred to indistinctly as air or gas, unless expressly indicated otherwise). The second reservoir 230 may include at least two valves, such as upper and lower gas valves 234 and 236, which may extend through the second reservoir 230, such as through a side 238 of the second reservoir 230. The internal cavity 232 of the second reservoir 230 is in selective fluid communication with the internal cavity 212 of the first reservoir 210 for selectively releasing a compressed gas 700 from within the internal cavity 232 to the internal cavity 212 of the first reservoir 210 as discussed in more detail hereinbelow. In some embodiments, the second reservoir 230 can be supported within the first reservoir 210 by various means such as, but not limited to, welding, brackets, etc.

As further shown in FIG. 6, the second reservoir 230 may further include an admission valve 240, configured to selectively allow fluid communication with the internal cavity 232 of the second reservoir 230 to fill the second reservoir 230 with a gas or air such as, but not limited to, a compressed air or gas 700. In some embodiments, the admission valve 240 may extend from a top end 242 of the second reservoir 230. Compressed gas from an external source (not shown) may be driven through the admission valve 240 to fill the internal cavity 232 of the second reservoir 230 with compressed gas 700 for subsequent release into the internal cavity 212 of the first reservoir 210, as will be described in greater detail hereinafter. The admission valve 240 may extend through a second top opening 244 in the first reservoir 210 and may be sealed within the second top opening 244 to prevent the leakage of compressed gas 700 out and of water 1020 into the first reservoir 210.

Figure 7:
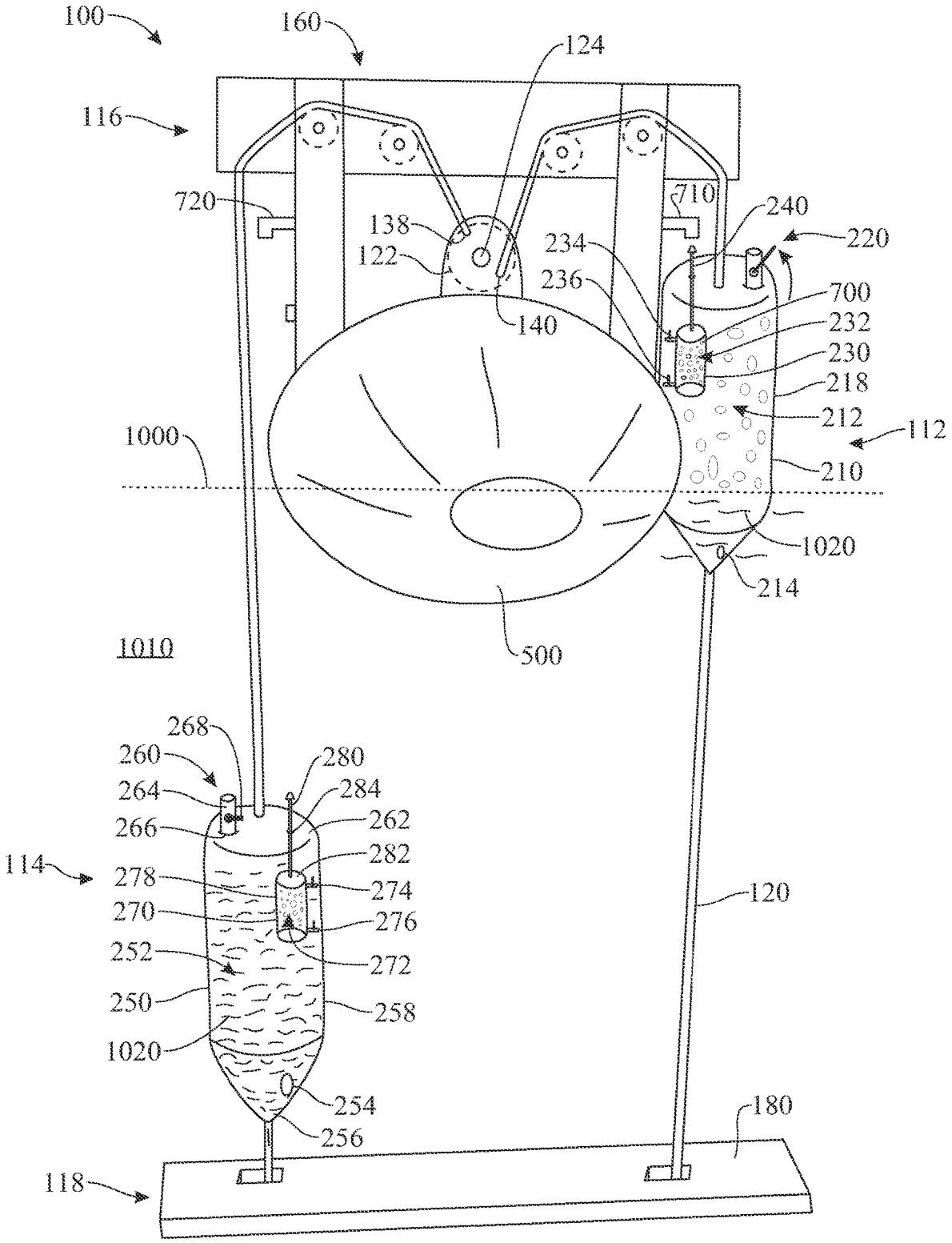
FIG. 7 presents a partial front perspective view of the buoyancy energy conversion system of FIG. 1, illustrating movement of opposed buoyancy tanks beneath a surface of water.

As shown for instance in FIG. 7, the drive cable 120 is affixed to the first buoyancy tank 112 to allow the first buoyancy tank 112 to pull on, and thereby move, the drive cable 120 as the first buoyancy tank 112 moves up and down within the water column. The drive cable 120 may extend through the first reservoir 210 or may be attached to the top and bottom ends 222 and 216, respectively, of the first reservoir 210. The drive cable 120 is similarly affixed to the second buoyancy tank 114.

Turning to FIGS. 7-10, the operation of the disclosed buoyancy energy conversion system 100 to rotate the drive shaft 124 will now be described. The following description of operation will be generally given with regard to the movement of the first buoyancy tank 112, however, it should be noted that the operation of the second buoyancy tank 114 is identical and reciprocal to that of the first buoyancy tank 112. With reference to FIG. 7, the second buoyancy tank 114 may be identical to the first buoyancy tank 112 and includes a generally hollow, first reservoir 250 defining an internal cavity 252 and a bottom opening 254 at a bottom end 256 of the first reservoir 250. The first reservoir 250 further includes a cylindrical central portion 258 and an exhaust valve 260 extending through a top end 262 of the first reservoir 250. The exhaust valve 260 includes an exhaust tube 264 extending through a first opening 266 in the top end 262 of the first reservoir 250 and a valve actuator 268 to open and close the exhaust valve 260.

Also similarly to the first buoyancy tank 112 described hereinabove, the second buoyancy tank 114 includes a second reservoir 270 comprising an internal cavity 272 and upper and lower gas valves 274 and 276, respectively, extending though a side 278 of the second reservoir 270. The second buoyancy tank 114 further includes an admission valve 280 extending through a top end 282 of the second reservoir 270 and a second opening 274 in the top end 262 of the first reservoir 250.

As further shown in FIG. 7, the buoyancy energy conversion system 100 is mounted on the boat 500 floating on the surface or at the water level 1000. In an initial condition, the first buoyancy tank 112 is at a highest position partially above the water level 1000 and the second buoyancy tank 114 is at a lowest position adjacent the lower frame assembly 118. The internal cavity 252 of the first reservoir 250 of the second buoyancy tank 114 is filled with water 1020, and the second reservoir 270 of the second buoyancy tank 114 is filled with compressed gas 700.

With regard to the first buoyancy tank 112, the exhaust valve 220 has opened as the first buoyancy tank 112 has moved above the water level 1000 to exhaust compressed gas 700 contained within the internal cavity 212 of the first reservoir 210. Eventually, the first buoyancy tank 112 has reached the highest position of its reciprocal trajectory, shown in the figure, in which a top portion of the first buoyancy tank 112 is above water level, or water line 1000, and a bottom portion of the first buoyancy tank 112 remains below the water line 1000. With the first buoyancy tank 112 partially submerged, water 1020 may enter the internal cavity 212 of the first buoyancy tank 112 through the opening 214 in the bottom end 216 of the first reservoir 210 to begin to fill the first reservoir 210.

At the same time, a first source of compressed gas 710 engages the admission valve 240 to begin to fill the internal cavity 232 of the second reservoir 230 of the first buoyancy tank 112. As the gas 700 enters the second reservoir 230, any remaining water is purged out of the second reservoir 230 through the upper and lower gas valves 234 and 236. The upper gas valve 234 closes shortly thereafter to allow the second reservoir 230 to fill with compressed gas 700 and, once all the water has been purged from the second reservoir 230, the lower gas valve 236 closes and the first source of compressed gas 710 continues to fill the second reservoir 230 with compressed gas 700 to the desired pressure. The desired pressure is chosen to be high enough to completely fill the internal cavity 212 of the first reservoir 210 at the depth of the lower frame assembly 118. In a non-limiting example, the second reservoir 230 may be filled to 130 pounds per square inch (psi).

Figure 8:
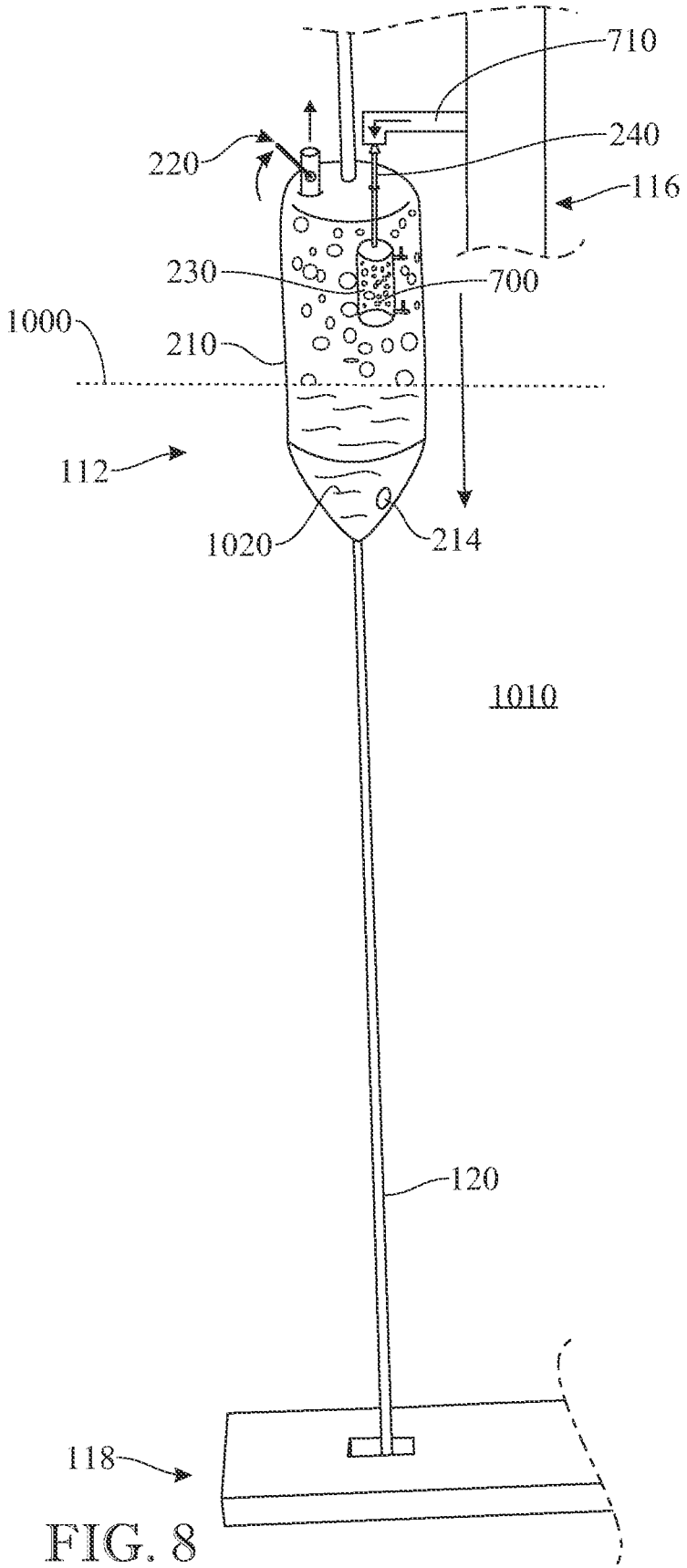
FIG. 8 presents a rear perspective view of one of the buoyancy tanks of FIG. 7 in initial descending motion withing the buoyancy energy conversion system of FIG. 1.
Figure 9:
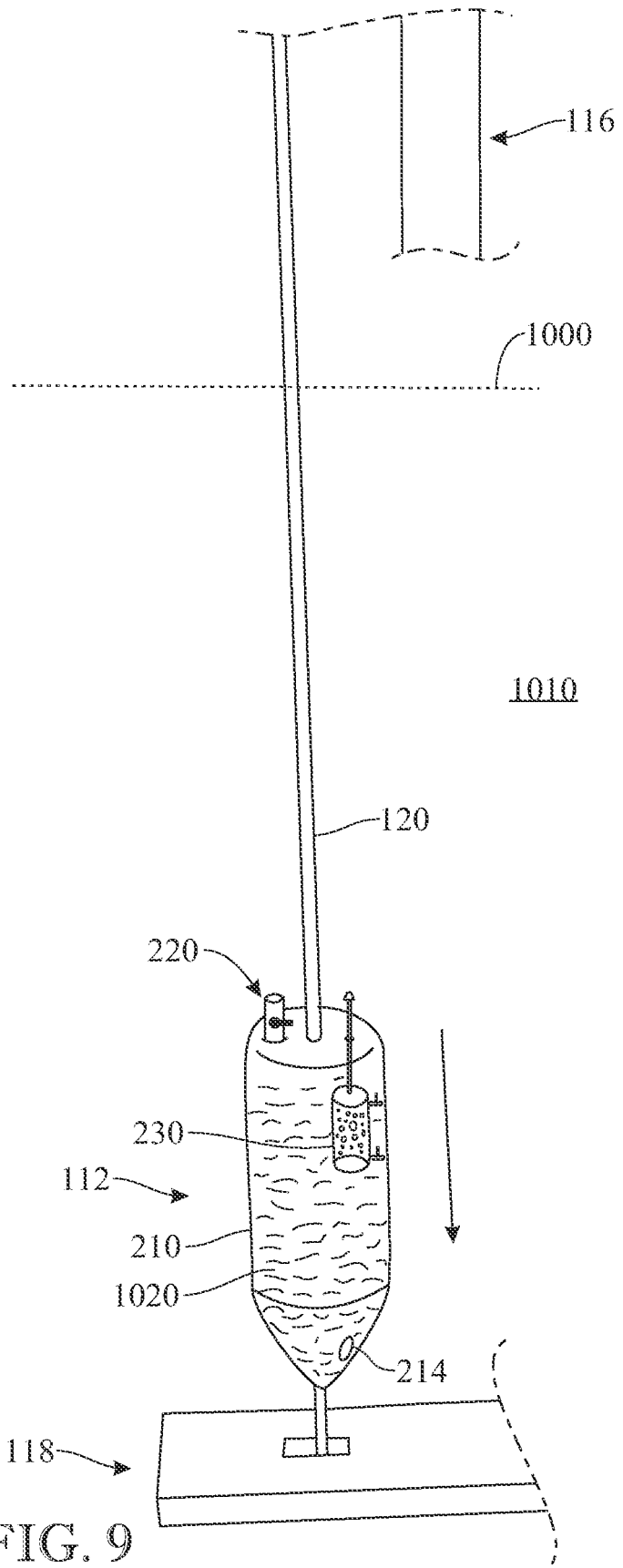
FIG. 9 presents a rear perspective view, similar to FIG. 8, with the buoyancy tank fully descended within the buoyancy energy conversion system of FIG. 1.

Referring to FIG. 8, once the second reservoir 230 has been filled with compressed gas 700, the admission valve 240 closes and the first buoyancy tank 112 begins to sink through the water column 1010 due to the weight of the first buoyancy tank 112 (and the rising of the opposed second buoyancy tank 114). The exhaust valve 220 remains open as the first buoyancy tank 112 descends through the water column 1010 towards its lowest point adjacent the lower frame assembly 118 (FIG. 9). This allows the internal cavity 212 of the first reservoir 210 to gradually fill with water entering the internal cavity 212 through the bottom opening 214 as the first buoyancy tank 112 descends through the water column 1010, and the pressure within the internal cavity 212 to match the pressure within the surrounding water, enabling the first buoyancy tank 112 to descend.

In addition, as the first buoyancy tank 112 descends through the water column 1010, the first buoyancy tank 112 pulls the drive cable 120 in a first direction to rotate the drive disk 122, and thus the drive shaft 124, in a first direction. It should be noted that the second buoyancy tank 114 is filled with compressed gas 700 and is rising in the water column 1010 to allow the drive cable 120 to move up on that side and thus to pull downward on the first buoyancy tank 112 and cause the first buoyancy tank 112 to move downward. As noted hereinabove, the upper pulley assembly 160 in the upper frame assembly 116 and the lower roller assembly 190 in the lower frame assembly 118 facilitate the smooth movement of the drive cable 120.

Referring to FIG. 9, once the first buoyancy tank 112 has reached the lowest point in the water column 1010 adjacent the lower frame assembly 118, the exhaust valve 220 is switched to a closed position, and the upper and lower gas valves 234 and 236 of the second reservoir 230 are switched to an open position. Consequently, compressed gas within the internal cavity 232 of the second reservoir 230 is released into the internal cavity 212 of the first reservoir 210, and a top area of the internal cavity 212 begins to fill with the compressed gas 700. As the internal cavity 212 is filled with compressed gas 700, the compressed gas 700 expands within the internal cavity 212 and the water 1020 contained therein is forced out through the bottom opening 214 of the first reservoir 210.

Figure 10:
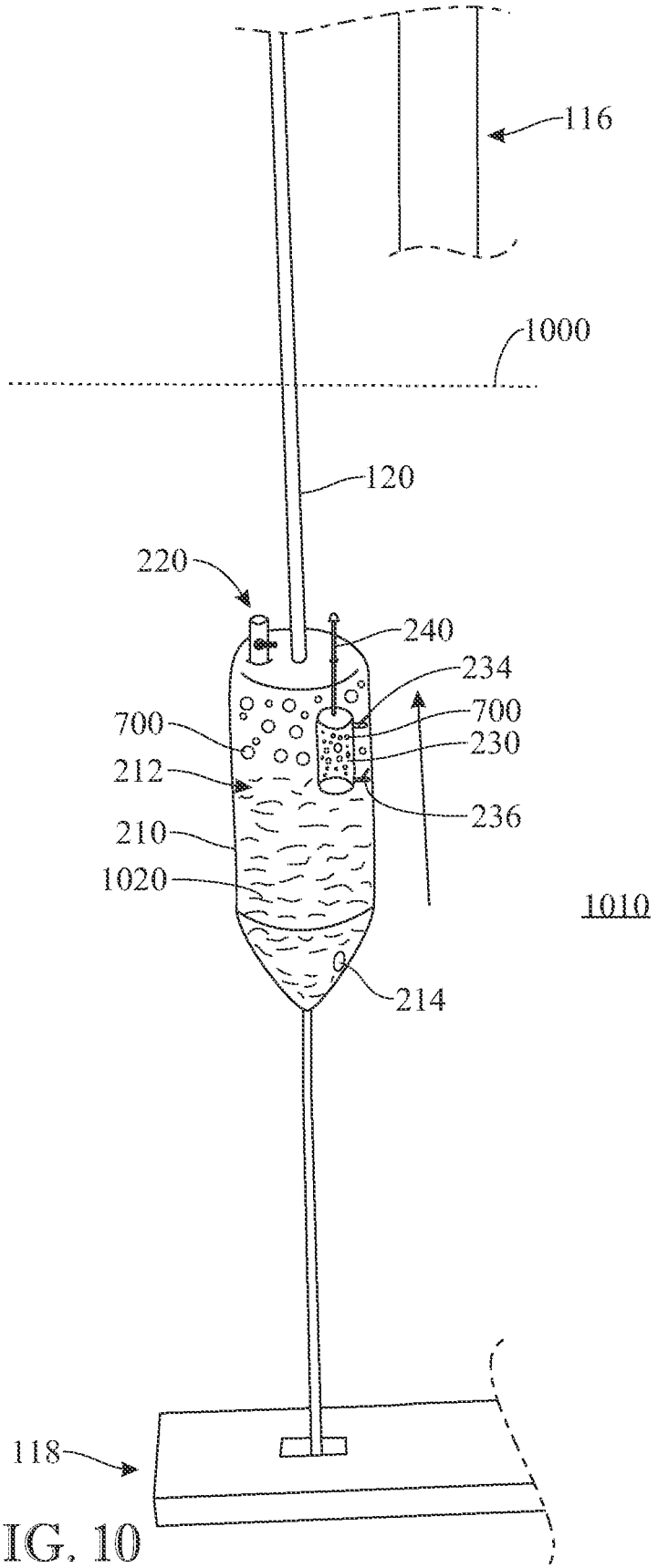
FIG. 10 presents a rear perspective view, similar to FIG. 9, with the buoyancy tank ascending within the buoyancy energy conversion system of FIG. 1.

With reference to FIG. 10, as the first reservoir 210 fills with compressed gas 700, the first buoyancy tank 112 becomes sufficiently buoyant to begin rising within the water column 1010 and pulling upward on the drive cable 120, which in turn starts pulling downward on the opposite, second buoyancy tank 114 (which has reached its highest position when the first buoyancy tank 112 reached its respective lowest position). Thus, as the first buoyancy tank 112 rises, the second buoyancy tank 114 begins to sink through the water column 1010 and fill with water to pull the drive cable 120 and continue exerting a torque on the drive disk 122, to continue rotating the drive disk 122 and drive shaft 124. In some embodiments, opposite ends of the drive cable 120 may be attached at two different points 138, 140 (as shown for instance in FIG. 7) to the drive disk 122 preferably at 180 degrees from one another and such that the ends of the drive cable 120 are connected to the drive disk 122 by means of a rotatable joint or connection, facilitating constant rotation of the drive disk 122 in a same direction by alternate pulling of each of the two ends of the drive cable 122.

Once the first buoyancy tank 112 reaches the surface or water level 1000, the process is repeated, i.e, the exhaust valve 220 is opened to exhaust the gas 700 from within the first reservoir 210 and the admission valve 240 reengages the first source of compressed gas 710 to again begin filling the second reservoir 230 with compressed gas.

As noted hereinabove, the operation of the second buoyancy tank 114 is identical and reciprocal to that of the first buoyancy tank 112. The second buoyancy tank 114 may be supplied by a second source of compressed gas 720, which may feed from a same or different gas source (e.g., compressed gas tank, or compressor) as the first source of compressed gas 710.

Thus, the disclosed buoyancy energy conversion system 100 provides a novel and economical device and method for rotating a drive shaft through the use of buoyant forces. It should be noted that the buoyancy energy conversion system 100 may work in conjunction with further sources of energy to power the buoyancy energy conversion system 100. For instance and without limitation, an electrical power source may be used to power an air compressor and provide said compressed air at the first and second sources of compressed gas 710, 720 to fill the second reservoirs 230, 270 as described heretofore.

Figure 11:
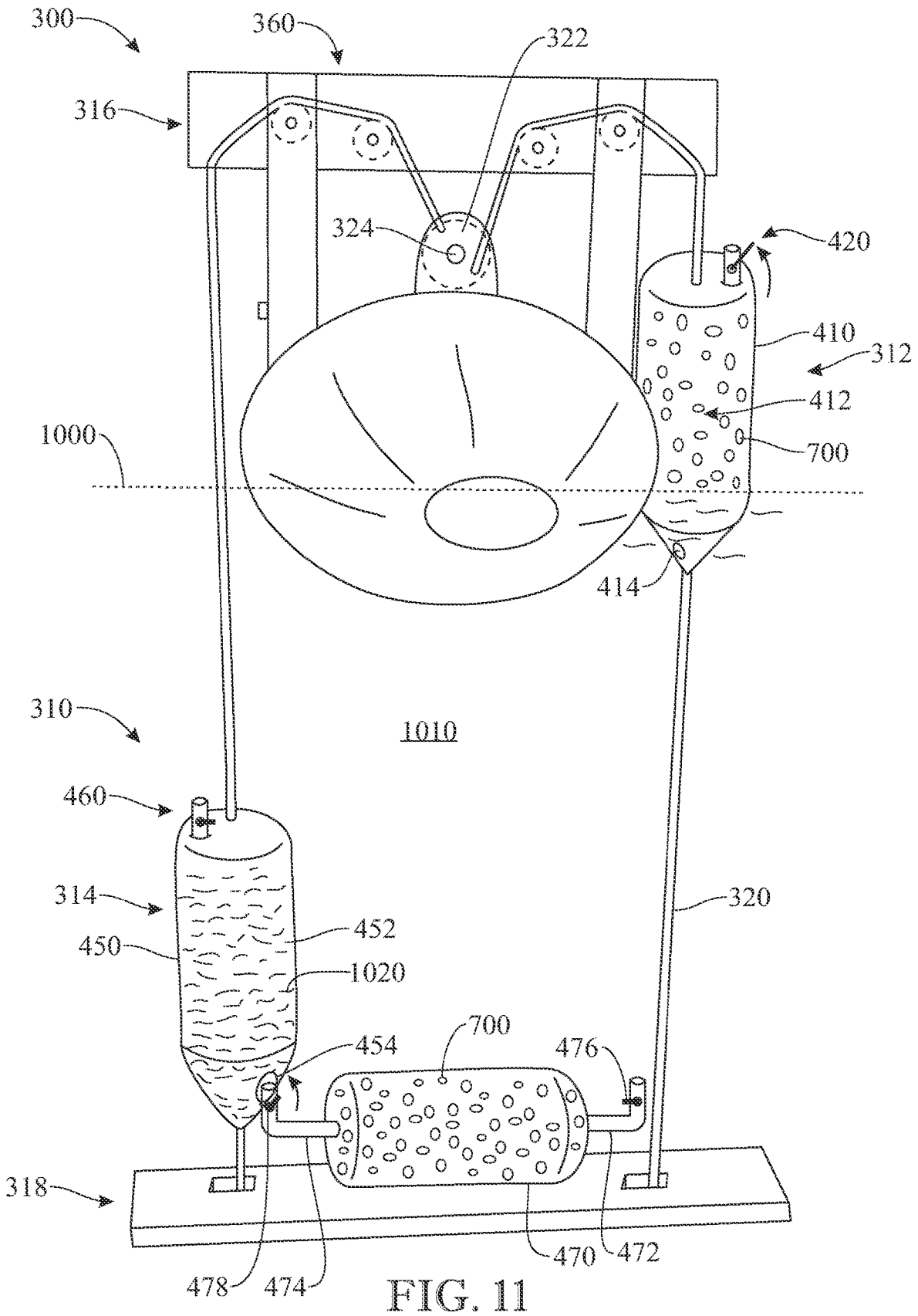
FIG. 11 presents a partial front perspective view of a buoyancy energy conversion system, attached to a floating structure, in accordance with a second illustrative embodiment of the present invention.

Turning to FIG. 11, there is disclosed a second embodiment of a buoyancy energy conversion system 300 in accordance with the present invention. The buoyancy energy conversion system 300 is substantially similar to the buoyancy energy conversion system 100 described hereinabove, and comprises a pair of buoyancy tanks 310 including a first buoyancy tank 312 and a second buoyancy tank 314. The buoyancy energy conversion system 300 additionally includes an upper frame assembly 316 and a lower frame assembly 318 identical to the upper and lower frame assemblies 116 and 118, respectively, described hereinabove with regard to the buoyancy energy conversion system 100.

Furthermore, identical to that described hereinabove, the buoyancy energy conversion system 300 includes a drive cable 320 attached to a rotating drive disk 322 having a drive shaft 324. The buoyancy energy conversion system 300 still further includes an upper pulley system 360 and a lower roller system and weight (not shown but otherwise the same or similar to the lower pulley or roller assembly 190 and weight 126 of the previous embodiment).

In contrast to that described hereinabove, the first and second buoyancy tanks 312 and 314 of the present embodiment do not include second reservoirs or admission valves. The first buoyancy tank 312 includes a first reservoir 410 comprising an internal cavity 412, a bottom opening 414, and an exhaust valve 420. Likewise, the second buoyancy tank 314 includes a first reservoir 450 comprising an internal cavity 452, a bottom opening 454, and exhaust valve 460.

In this embodiment, the compressed gas 700 which drives the upward traveling of the first and second buoyancy tanks 312, 314 is contained in, and provided by, a compressed gas tank 470 mounted on the lower frame assembly 318. In a non-limiting example, the compressed gas tank 470 may be associated with an electrolysis apparatus that generates hydrogen and oxygen from water (e.g., from water 1020 from the water column 1010) to be stored in the compressed gas tank 470. The compressed gas tank 470 may be connected to, and in fluid communication with, a first outlet tube 472 having a first outlet valve 476 and a second outlet tube 474 having a second outlet valve 478. The first and second outlet valves 476 and 478, respectively, may normally be switched to a closed condition. In operation, as the second buoyancy tank 314 descends, the second outlet tube 474 may enter the opening 454 in the first reservoir 450 of the second buoyancy tank 314, and the second outlet valve 478 may be switched to an open condition allowing compressed gas 700 to be forced into the internal cavity 452 of the first reservoir 450, causing the second buoyancy tank 314 to rise. In this condition, the exhaust valve 460 is closed. In some embodiments, when injecting compressed gas 700 into the internal cavity 452, water 1020 from inside the internal cavity 452 may be expelled into the water column 1010 through the bottom opening 454 (such as by having the second outlet valve 478 fit loosely within the bottom opening 454 such that a gap is formed therebetween), or through a separate opening, such as a second bottom opening 454, formed through the first reservoir 450. After the second buoyancy tank 314 begins to rise, the second outlet valve 478 closes.

As the second buoyance tank 314 begins to rise, the second buoyancy tank 314 pulls on the drive cable 320. The first buoyancy tank 312 is pulled down by the drive cable 320 and the weight of the first buoyancy tank 312. The exhaust valve 420 opens, releasing the compressed gas 700 from the internal cavity 412 and allowing water 1020 to enter the internal cavity 412 of the first reservoir 410 through the opening 414. Once the first buoyancy tank 312 reaches the lower frame assembly 318, the first outlet tube 472 enters the opening 414 in the first reservoir 410 and the first outlet valve 476 is switched open, thereby filling the first reservoir 410 with compressed gas and causing the first reservoir 410 to rise.

At the same time, the opposite is happening to the second buoyancy tank 314 when it reaches the water level 1000; more specifically, the exhaust valve 460 opens to release the compressed gas 700 and allow the internal cavity 452 to fill with water. This repeated rising and falling of the first and second buoyancy tanks 312 and 314 in the water column 1010 pulls on the drive cable 320 in a coordinated manner to rotate the drive disk 322 and thus the drive shaft 324.

Further embodiments are contemplated in which a weight (e.g., a 200 kg weight) were incorporated to each one of the first and second buoyancy tanks, the weights configured to increase a downward pulling force and decrease an upward pulling force of each one of the first and second buoyancy tanks onto the other one of the first and second buoyancy tanks.

The buoyancy energy conversion system of the present disclosure therefore converts buoyant forces to rotational energy, which may be provided at a drive disk, drive shaft and/or other drive element which is rotated by the buoyancy energy conversion system and configured to transfer rotational energy to a separate device or system. The device or system receiving rotational energy from the buoyancy energy conversion system may be any applicable system, such as, but not limited to, an electrical power generator. The device or system receiving rotational energy from the buoyancy energy conversion system may be located on the supporting structure, outside or separate from the supporting structure, within the body of water, or in any applicable location or mounting position which enables the device or system to receive rotational energy from the buoyancy energy conversion system.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method for converting buoyant forces to rotational energy, the method comprising the steps of:

obtaining a buoyancy energy conversion system comprising a pair of buoyancy tanks, a drive cable, and a rotatable driven member, wherein each buoyancy tank of the pair of buoyancy tanks comprises a respective first reservoir defining a respective internal cavity, wherein the drive cable interconnects the pair of buoyancy tanks to the rotatable driven member and is configured to drive the rotatable driven member for rotation, wherein the buoyancy energy conversion system is arranged in a body of water comprising a water surface level, and further wherein said each buoyancy tank is configured to travel reciprocally upward and downward along the body of water and exert a respective upward pulling force on the drive cable when traveling upward along the body of water;

for each buoyancy tank of the pair of buoyancy tanks:

a) allowing said each buoyancy tank to travel downward through the body of water from an upper position to a lower position as a result of the other buoyancy tank exerting its respective upward pulling force on the drive cable as said other buoyancy tank travels upward through the body of water, b) as said each buoyancy tank travels downward through the body of water, driving said rotatable driven member for rotation by applying a torque on the rotatable driven member, the torque caused by a pulling on the rotatable driven member exerted by the drive cable, c) with said each buoyancy tank at the lower position, injecting compressed gas into the respective internal cavity of the respective first reservoir of said each buoyancy tank, d) allowing said each buoyancy tank to travel upward through the body of water as a result of said compressed gas occupying the respective internal cavity of the respective first reservoir of said each buoyancy tank, e) as said each buoyancy tank travels upward through the body of water, exerting the respective upward pulling force of said each buoyancy tank on the drive cable, f) with said each buoyancy tank at the upper position, expelling said compressed gas from said respective internal cavity of the respective first reservoir of said each buoyancy tank; and repeating steps a) through f) cyclically.

2. The method of claim 1, wherein:

the step of allowing said each buoyancy tank to travel downward through the body of water comprises pulling said each buoyancy tank downward by a downward pulling force exerted on said each buoyancy tank by la lower segment of the drive cable, the lower segment extending from said each buoyancy tank to said other buoyancy tank, said downward pulling force caused by the other buoyancy tank exerting its respective upward pulling force on the lower segment of the drive cable.

3. The method of claim 2, wherein:

the step of allowing said each buoyancy tank to travel downward through the body of water further comprises allowing the drive cable to travel along a lower pulley assembly, the lower pulley assembly configured to convert the respective upward pulling force of the other buoyancy tank to said downward pulling force.

4. The method of claim 1, further comprising the step of:

for each buoyancy tank of the pair of buoyancy tanks, pulling downward on an upper segment of the drive cable by said each buoyancy tank as said each buoyancy tank travels downward through the body of water, the pulling downward on the upper segment of the drive cable by said each buoyancy tank causing the upper segment of the drive cable to exert said pulling on the rotatable driven member.

5. The method of claim 1, wherein, for each buoyancy tank of the pair of buoyancy tanks, the drive cable is configured to exert said pulling on the rotatable driven member at a respective point of the rotatable driven member, the respective points arranged diametrically opposed along the rotatable driven member with respect to a rotation axis of the rotatable driven member.

6. The method of claim 1, wherein the step of injecting compressed gas into the respective internal cavity of the respective first reservoir of said each buoyancy tank comprises injecting compressed gas from a second reservoir of said each buoyancy tank, the second reservoir configured to travel upward and downward along the body of water jointly with said each buoyancy tank.

7. The method of claim 6, further comprising the step of:

for each buoyancy tank of the pair of buoyancy tanks, loading the second reservoir of said each buoyancy tank with compressed gas after allowing said each buoyancy tank to travel upward through the body of water.

8. The method of claim 7, wherein the step of loading the second reservoir of said each buoyancy tank is carried out with said each buoyancy tank at the upper position.

9. The method of claim 1, wherein the step of injecting compressed gas into the respective internal cavity of the respective first reservoir of said each buoyancy tank comprises injecting compressed gas from a compressed gas tank arranged externally to said each buoyancy tank and not configured to travel upward and downward with said each buoyancy tank.

10. The method of claim 9, comprising the step of providing said compressed gas tank at said lower position.

11. The method of claim 1, wherein, when said each buoyancy tank is arranged in the upper position, an upper part and a lower part of said each buoyancy tank are arranged above and below the water surface level, respectively.

12. The method of claim 1, wherein the step of expelling said compressed gas comprises opening an exhaust valve of said each buoyancy tank to allow compressed gas to be expelled through said exhaust valve.

13. The method of claim 12, further comprising the step of closing the exhaust valve of said each buoyancy tank once said each buoyancy tank has reached the lower position and prior to the step of injecting compressed gas.

14. The method of claim 1, further comprising the step of:

for each buoyancy tank of the pair of buoyancy tanks, allowing water from the body of water to enter the respective internal cavity of the respective first reservoir of said each buoyancy tank as said each buoyancy tank travels downward through the body of water.

15. The method of claim 1, further comprising the step of:

for each buoyancy tank of the pair of buoyancy tanks, allowing water to be discharged from the respective internal cavity of the respective first reservoir of said each buoyancy tank into the body of water as said each buoyancy tank travels upward through the body of water.

16. The method of claim 1, further comprising the step of:

for each buoyancy tank of the pair of buoyancy tanks, allowing water from the body of water to enter the respective internal cavity of the respective first reservoir of said each buoyancy tank through a respective opening formed in said each buoyancy tank as said each buoyancy tank travels downward through the body of water, for each buoyancy tank of the pair of buoyancy tanks, allowing water to be discharged from the respective internal cavity of the respective first reservoir of said each buoyancy tank through the respective opening of said each buoyancy tank into the body of water as said each buoyancy tank travels upward through the body of water.

17. The method of claim 16, wherein, when said each buoyancy tank is arranged in the upper position, an upper part and a lower part of said each buoyancy tank are arranged above and below the water surface level, respectively, the lower part comprising the respective opening of said each buoyancy tank.

18. The method of claim 17, wherein the step of expelling said compressed gas comprises opening an exhaust valve of said each buoyancy tank to allow compressed gas to be expelled through said exhaust valve, and further wherein the exhaust valve is provided at said upper part.

19. A method for converting buoyant forces to rotational energy, the method comprising the steps of:

obtaining a buoyancy energy conversion system comprising a pair of buoyancy tanks, a drive cable, and a rotatable driven member, wherein each buoyancy tank of the pair of buoyancy tanks comprises a respective first reservoir defining a respective internal cavity, wherein the drive cable interconnects the pair of buoyancy tanks to the rotatable driven member and is configured to drive the rotatable driven member for rotation, wherein the buoyancy energy conversion system is arranged in a body of water comprising a water surface level, and further wherein said each buoyancy tank is configured to travel reciprocally upward and downward along the body of water and exert a respective upward pulling force on the drive cable when traveling upward along the body of water;

for each buoyancy tank of the pair of buoyancy tanks:

a) allowing said each buoyancy tank to travel downward through the body of water from an upper position to a lower position as a result of a downward pulling force exerted on said each buoyancy tank by a lower segment of the drive cable, the downward pulling force resulting from the other buoyancy tank exerting its respective upward pulling force on the lower segment of the drive cable as said other buoyancy tank travels upward through the body of water, the lower segment extending from said each buoyancy tank to said other buoyancy tank, b) as said each buoyancy tank travels downward through the body of water, driving said rotatable driven member for rotation by applying a torque on the rotatable driven member, the torque caused by a pulling on the rotatable driven member exerted by an upper segment of the drive cable, the pulling on the rotatable driven member resulting from a downward pulling on the upper segment of the drive cable by said each buoyancy tank, c) with said each buoyancy tank at the lower position, injecting compressed gas into the respective internal cavity of the respective first reservoir of said each buoyancy tank, d) allowing said each buoyancy tank to travel upward through the body of water as a result of said compressed gas occupying the respective internal cavity of the respective first reservoir of said each buoyancy tank, e) as said each buoyancy tank travels upward through the body of water, exerting the respective upward pulling force of said each buoyancy tank on the drive cable, and f) with said each buoyancy tank at the upper position, expelling said compressed gas from said respective internal cavity of the respective first reservoir of said each buoyancy tank; and repeating steps a) through f) cyclically.

20. A method for converting buoyant forces to rotational energy, the method comprising the steps of:

obtaining a buoyancy energy conversion system comprising a pair of buoyancy tanks, a drive cable, and a rotatable driven member, wherein each buoyancy tank of the pair of buoyancy tanks comprises a respective first reservoir defining a respective internal cavity, wherein the drive cable interconnects the pair of buoyancy tanks to the rotatable driven member and is configured to drive the rotatable driven member for rotation, wherein the buoyancy energy conversion system is arranged in a body of water comprising a water surface level, and further wherein said each buoyancy tank is configured to travel reciprocally upward and downward along the body of water and exert a respective upward pulling force on the drive cable when traveling upward along the body of water;

for each buoyancy tank of the pair of buoyancy tanks:

a) allowing said each buoyancy tank to travel downward through the body of water from an upper position to a lower position as a result of a downward pulling force exerted on said each buoyancy tank by a lower segment of the drive cable, the downward pulling force resulting from the other buoyancy tank exerting its respective upward pulling force on the lower segment of the drive cable as said other buoyancy tank travels upward through the body of water, the lower segment extending from said each buoyancy tank to said other buoyancy tank, b) as said each buoyancy tank travels downward through the body of water, allowing water from the body of water to enter the respective internal cavity of the respective first reservoir of said each buoyancy tank, c) as said each buoyancy tank travels downward through the body of water, driving said rotatable driven member for rotation by applying a torque on the rotatable driven member, the torque caused by a pulling on the rotatable driven member exerted by an upper segment of the drive cable, the pulling on the rotatable driven member resulting from a downward pulling on the upper segment of the drive cable by said each buoyancy tank, d) with said each buoyancy tank at the lower position, injecting compressed gas into the respective internal cavity of the respective first reservoir of said each buoyancy tank, e) allowing said each buoyancy tank to travel upward through the body of water as a result of said compressed gas occupying the respective internal cavity of the respective first reservoir of said each buoyancy tank, f) as said each buoyancy tank travels upward through the body of water, exerting the respective upward pulling force of said each buoyancy tank on the drive cable, g) as said each buoyancy tank travels upward through the body of water, allowing water to be discharged from the respective internal cavity of the respective first reservoir of said each buoyancy tank into the body of water, and h) with said each buoyancy tank at the upper position, expelling said compressed gas from said respective internal cavity of the respective first reservoir of said each buoyancy tank; and repeating steps a) through f) cyclically.

* * * * *